US005413892A

United States Patent [19]

Matsuura et al.

[11] Patent Number: 5,413,892

[45] Date of Patent: May 9, 1995

[54] ELECTROSTATIC IMAGE DEVELOPING TONER

[75] Inventors: Yuji Matsuura; Osamu Mukudai; Mitsutoshi Anzai; Kayoko Watanabe, all of Tsukuba, Japan

[73] Assignee: Hodogaya Chemical Co., Ltd., Tokyo, Japan

[21] Appl. No.: 245,542

[22] Filed: May 18, 1994

[30] Foreign Application Priority Data

May 24, 1993 [JP] Japan ..... 5-142553

[51] Int. Cl.[6] ..... G03G 9/097

[52] U.S. Cl. ..... 430/110; 430/903

[58] Field of Search ..... 430/110, 903

[56] References Cited

U.S. PATENT DOCUMENTS 5,272,212 12/1993 Kitahara ..... 525/386 X 5,346,794 9/1994 Anzai et al. ..... 430/110

FOREIGN PATENT DOCUMENTS 2121204 12/1983 United Kingdom .

2121205 12/1983 United Kingdom .

*Primary Examiner*—Roland Martin

*Attorney, Agent, or Firm*—Oblon, Spivak, McClelland, Maier & Neustadt

[57] ABSTRACT

An electrostatic image developing toner containing a compound of the following formula (1):

(1)

wherein X is (wherein D is a hydrogen atom or an electron donating group, and each of $R_1$ and $R_2$ which are independent of each other, is a hydrogen atom, an alkyl group, a cycloalkyl group, an alkoxy group, an aryl group, an aralkyl group, a hydroxyl group, an amino group, a dialkylamino group, a diarylamino group, a diaralkylamino group, a halogen atom, a halogen-substituted alkyl group, a halogen-substituted aryl group, a cyano group, a formyl group, a carboxyl group, a carbamoyl group, an N-substituted carbamoyl group, an alkoxycarbonyl group, an acyloxy group, an acyl group, an arylcarbonyl group, a nitro group, a sulfonic acid group, an alkylsulfonyl group, a substituted sulfonyl group, a sulfamoyl group, an N-substituted sulfamoyl group or a substituted sulfinyl group, provided that when D is a hydrogen atom, $R_1$ and $R_2$ are not simultaneously hydrogen atoms and at least one substituent other than a hydrogen atom is substituted at the 2-position, or $R_1$ and $R_2$ together form a ring), (wherein D, $R_1$ and $R_2$ are as defined above, or (wherein D, $R_1$ and $R_2$ are as defined above.

4 Claims, No Drawings

ELECTROSTATIC IMAGE DEVELOPING TONER

The present invention relates to an electrostatic image developing toner containing a certain specific compound.

In an image-forming process by means of an electrophotographic system, an electrostatic-latent image is formed on an inorganic photoconductive material such as selenium, a selenium alloy, a cadomium sulfide or amorphous silicon, or on an organic photoconductive material employing a charge-generating material and a charge-transporting material, and the latent image is developed by a toner, then transferred and fixed on a paper sheet or plastic film to obtain a visible image.

The photoconductive material may be positively electrifiable or negatively electrifiable depending upon its construction. When a printed portion is remained as an electrostatic latent image by exposure, development is conducted by means of an oppositely electrifiable toner. On the other hand, when a printed portion is destatisized for reversal development, development is conducted by means of an equally electrifiable toner. A toner is composed of a binder resin, a coloring agent and other additives. However, in order to impart desired tribocharge properties (such as desired charge up speed, tribocharge level and tribocharge level stability), stability with time and environmental stability, it is common to use a charge-control agent. The properties of the toner will be substantially affected by this charge-control agent.

In a case where a positively electrifiable photoconductive material is used for development with an oppositely electrifiable toner, or a negatively electrifiable photoconductive material is used for reverse development, a negatively electrifiable toner is used. In such a case, a negatively electrifiable charge-control agent is used.

Further, in a case of a color toner, it is necessary to use a colorless charge-control agent or a charge-control agent with a pale color which does not affect the color of the toner. Such pale-colored or colorless charge-control agents may, for example, be metal complex salt compounds of hydroxybenzoic acid derivatives disclosed in e.g. Japanese Examined Patent Publication No. 42752/1980 and Japanese Unexamined Patent Publication No. 69073/1986 and No. 221756/1986, aromatic dicarboxylic acid metal salt compounds disclosed in e.g. Japanese Unexamined Patent Publication No. 111541/1982, metal complex salt compounds of anthranilic acid derivatives disclosed in Japanese Unexamined patent Publication No. 141453/1986 and No. 94856/1987, organic boron compounds disclosed in e.g. U.S. Pat. No. 4,767,688 and Japanese Unexamined Patent Publication No. 306861/1989 and biphenol compounds disclosed in Japanese Unexamined Patent Publication No. 3149/1986.

However, these charge-control agents have various drawbacks such that some of them are chromium compounds which are likely to bring about environmental problems, some of them are materials which can not be completely colorless, many of them have low electrifying effects or provide oppositely electrifiable toners, or some of them are poor in dispersibility or chemical stability. Thus, none of them has fully satisfactory properties as a charge-control agent.

It is an object of the present invention to provide a charge-control agent which has high stability as a colorless compound and good dispersibility to the binder resin and being free from a deterioration during the preparation of a toner and which is capable of presenting a toner which has a good tribocharge property and which is capable of constantly presenting an image of high image quality under various environmental conditions.

The present inventors have found a colorless stable compound which has excellent dispersibility in a binder resin and which is capable of imparting an excellent tribocharge property to a toner, and have finally invented an excellent toner by using this compound as a charge-control agent.

Namely, the present invention provides an electrostatic image developing toner containing a compound of the following formula (1):

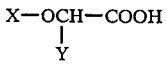

(1)

wherein X is

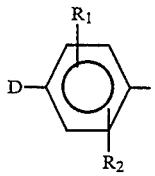

(wherein D is a hydrogen atom or an electron donating group, and each of $R_1$ and $R_2$ which are independent of each other, is a hydrogen atom, an alkyl group, a cycloalkyl group, an alkoxy group, an aryl group, an aralkyl group, a hydroxyl group, an amino group, a dialkylamino group, a diarylamino group, a diaralkylamino group, a halogen atom, a halogen-substituted alkyl group, a halogen-substituted aryl group, a cyano group, a formyl group, a carboxyl group, a carbamoyl group, an N-substituted carbamoyl group, an alkoxycarbonyl group, an acyloxy group, an acyl group, an arylcarbonyl group, a nitro group, a sulfonic acid group, an alkylsulfonyl group, a substituted sulfonyl group, a sulfamoyl group, an N-substituted sulfamoyl group or a substituted sulfinyl group, provided that when D is a hydrogen atom, $R_1$ and $R_2$ are not simultaneously hydrogen atoms and at least one substituent other than a hydrogen atom is substituted at the 2-position, or $R_1$ and $R_2$ together form a ring),

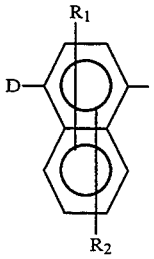

(wherein D, $R_1$ and $R_2$ are as defined above, provided that when D is a hydrogen atom, $R_1$ and $R_2$ are not simultaneously hydrogen atoms and at least one substituent other than a hydrogen atom is substituted at the 2-position, and $R_1$ and $R_2$ do not form a ring), or

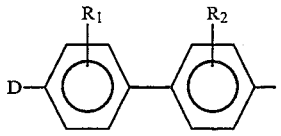

(wherein D, $R_1$ and $R_2$ are as defined above, provided that when D is a hydrogen atom, $R_1$ and $R_2$ are not simultaneously hydrogen atoms and at least one substituent other than a hydrogen atom is substituted at the 3-position, and $R_1$ and $R_2$ do not form a ring), and Y is a hydrogen atom, an alkyl group or an aryl group.

Now, the present invention will be described in detail with reference to the preferred embodiments.

Basically, the toner of the present invention comprises a binder resin, a coloring agent and the compound of the formula (1) of the present invention. As a method for producing the toner of the present invention, there may be mentioned a method wherein a mixture of such starting materials are kneaded by a heat-mixing apparatus while the binder resin is melted, and the mixture is then cooled, followed by rough pulverization, fine pulverization and classification, a method wherein a mixture of such starting materials is dissolved in a solvent and then sprayed to form fine particles, followed by drying and classification, or a method wherein the coloring agent and the compound of the formula (1) are dispersed in suspended monomer particles, followed by polymerization.

As the binder resin, a polystyrene, a styrene-methacrylate copolymer, a styrene-propylene copolymer, a styrene-butadiene copolymer, an acrylic resin, a styrene-maleic acid copolymer, an olefin resin, a polyester, an epoxy resin, a polyurethane resin, a polyvinyl butyral, etc., may be used alone or in combination as a mixture.

As the coloring agent, carbon black is commonly used for a black toner. For color toners, the following coloring agents are usually employed. Namely, as a yellow coloring agent, an azo-type organic pigment such as CI pigment yellow 1, CI pigment yellow 5, CI pigment yellow 12 or CI pigment yellow 17, an inorganic pigment such as yellow oshre, or an oil-soluble dye such as CI solvent yellow 2, CI solvent yellow 6, CI solvent yellow 14 or CI solvent yellow 19, may be mentioned. As a magenta coloring agent, an azo pigment such as CI pigment red 57 or CI pigment red 57:1, a xanthene pigment such as CI pigment violet 1 or CI pigment red 81, a thioindigo pigment such as CI pigment red 87, CI vat red 1 or CI pigment violet 38, or an oil-soluble dye such as CI solvent red 19, CI solvent red 49 or CI solvent red 52, may be mentioned. As a cyan coloring agent, a triphenyl methane pigment such as CI pigment blue 1, a phthalocyanine pigment such as CI pigment blue 15 or CI pigment blue 17, or an oil-soluble dye such as CI solvent blue 25, CI solvent blue 40 or CI solvent blue 70, may be mentioned.

Such a coloring agent is used usually in an amount of from 1 to 15 parts by weight, preferably from 3 to 10 parts by weight, per 100 parts by weight of the binder resin.

The electron donating group in the compound of the present invention useful as a charge-control agent, may, for example, be an alkyl group, a cycloalkyl group, an alkoxy group, an aryl group, an aralkyl group, a hydroxyl group, an amino group, a dialkylamino group, a diarylamino group or a diaralkylamino group.

The following compounds may be mentioned as specific examples of the compound of the present invention useful as a charge-control agent.

Compound No. 1

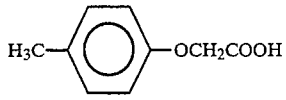

Compound No. 2

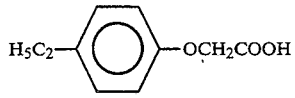

Compound No. 3

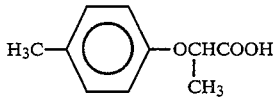

Compound No. 4

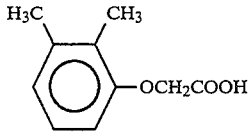

Compound No. 5

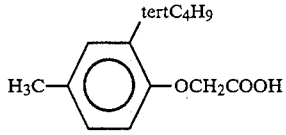

Compound No. 6

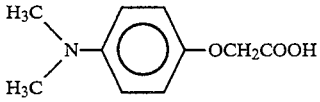

Compound No. 7

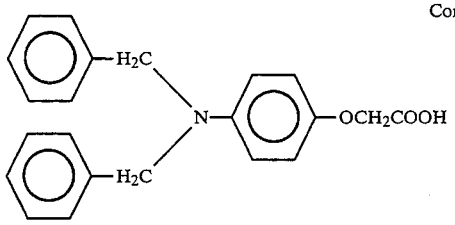

Compound No. 8

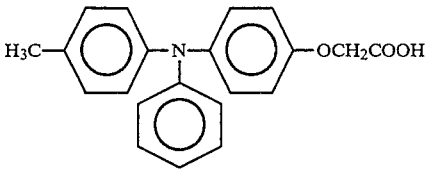

Compound No. 9

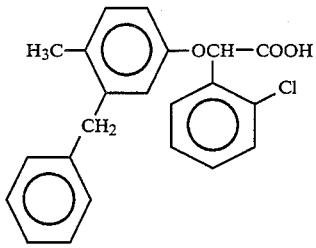

-continued
Compound No. 10
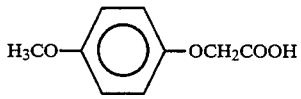
Compound No. 11
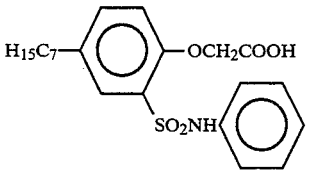
Compound No. 12
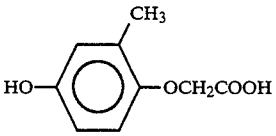
Compound No. 13
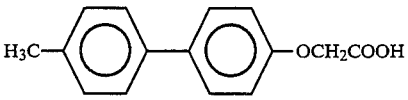
Compound No. 14
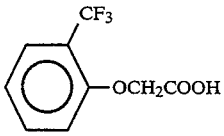
Compound No. 15
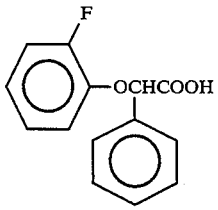
Compound No. 16
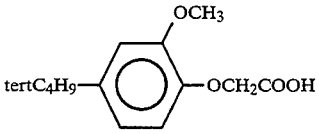
Compound No. 17
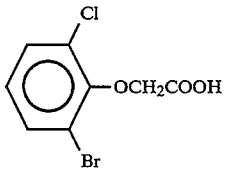
Compound No. 18
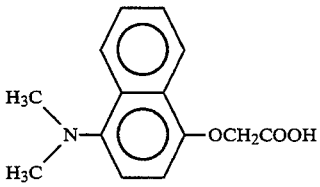
Compound No. 19
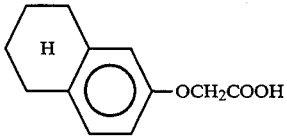
-continued
Compound No. 20
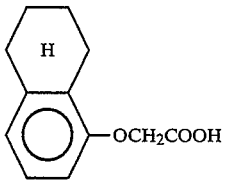
Compound No. 21
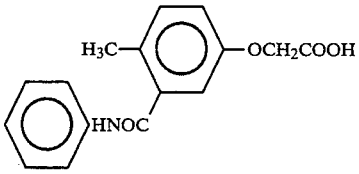
Compound No. 22
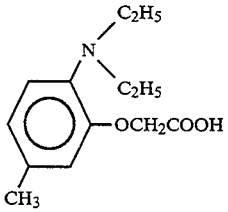
Compound No. 23
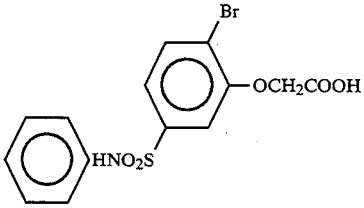
Compound No. 24
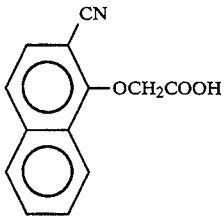
Compound No. 25
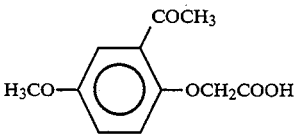
Compound No. 26
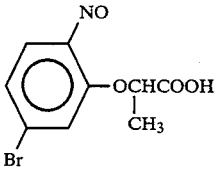
Compound No. 27
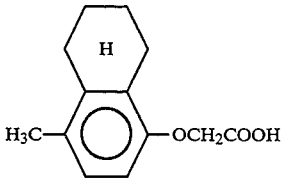

-continued

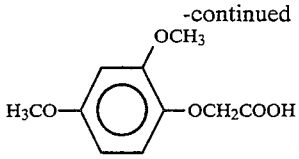

Compound No. 28

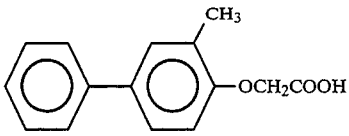

Compound No. 29

Such a charge-control agent is used usually in an amount of from 0.1 to 10 parts by weight, preferably from 0.5 to 5 parts by weight, per 100 parts by weight of the binder resin.

The toner may further contain various additives such as hydrophobic silica, metal soap, a fluorine-type surfactant, dioctyl phthalate, wax, tin oxide and electrically conductive zinc oxide for the purposes of protecting the photoconductive material or carrier, improving the flowability of the toner, regulating the thermal properties, electrical properties and physical properties, regulating the electrical resistance, regulating the softening point and improving the fixing property.

When the toner of the present invention is used for a two-component developing agent, there may be employed, as a carrier, fine glass beads, iron powder, ferrite powder or a binder-type carrier of resin particles having magnetic particles dispersed therein, or a resin coated carrier having its surface coated with a polyester resin, a fluorine resin, an acrylic resin or a silicon resin. Further, the toner of the present invention exhibits excellent performance when used as a one-component toner.

Now, the present invention will be described in further detail with reference to Examples. However, it should be understood that the present invention is by no means restricted by such specific Examples. In the following Examples, "parts" means "parts by weight".

EXAMPLE 1

One part of p-methylphenoxy acetic acid (Compound No. 1), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was negatively charged, and the tribocharge was measured by a blow off powder charge measuring apparatus and found to be −33 μc/g. This toner was used to copy an image by a modified commercially available copying machine, whereby copy images with an excellent image quality were obtained not only at the initial stage but also after copying 10,000 sheets.

EXAMPLE 2

One part of p-ethylphenoxy acetic acid (Compound No. 2), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus −25 μc/g. This toner was used to copy an image by a modified commercially available copying machine, whereby copy images with an excellent image quality were obtained not only at the initial stage but also after copying 10,000 sheets.

EXAMPLE 3

One part of p-methylphenoxy acetic acid (Compound No. 1), 5 parts of Spilon Blue 2BNH as a copper phthalocyanine type oil-soluble dye (product of Hodogaya Chemical Co., Ltd.) and 94 parts of a styrene-butyl methacrylate copolymer were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus −27 μc/g. This toner was used to copy an image by a modified commercially available copying machine, whereby copy images with an excellent image quality were obtained not only at the initial stage but also after copying 10,000 sheets.

EXAMPLE 4

One part of 2,3-dimethylphenoxy acetic acid (Compound No. 4), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicon resin coated carrier at a weight ratio of 4:100, and the mixture was shaked, whereby the toner was negatively charged, and the tribocharge measured by a blow off powder charge measuring apparatus was −18 μc/g. This toner was used to copy an image by a modified commercially available copying machine, whereby copy images with an excellent image quality were obtained not only at the initial stage but also after copying 10,000 sheets.

EXAMPLE 5

One part of p-methylphenoxy acetic acid (Compound No. 1), 40 parts of magnetic iron powder and 59 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a ferrite carrier, and the mixture was shaked, whereby the toner was negatively charged. This toner was used to copy an image by a modified commercially available copying machine for one-component toner, whereby copy images with an excellent image quality were obtained.

EXAMPLES 6 to 11

Experiments were conducted in the same manner as in Example 1 except that the compounds as identified in Table 1 were used instead of Compound No. 1 in Example 1, and the results are shown in Table 1.

TABLE 1

| Example No. | Compound No. | Tribo-charge of the toner (−μc/g) | Image quality | |
|---|---|---|---|---|
| | | | Initial | After copying 10,000 sheets |
| 6 | Compound No. 9 | 17 | Clear | Clear |
| 7 | Compound No. 10 | 22 | Clear | Clear |
| 8 | Compound No. 14 | 18 | Clear | Clear |
| 9 | Compound No. 18 | 15 | Clear | Clear |
| 10 | Compound No. 22 | 19 | Clear | Clear |
| 11 | Compound No. 25 | 13 | Clear | Clear |

We claim:

1. An electrostatic image developing toner containing a compound of the following formula (1):

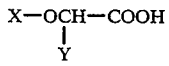

(1)

wherein X is

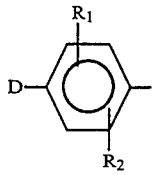

(wherein D is a hydrogen atom or an electron donating group, and each of $R_1$ and $R_2$ which are independent of each other, is a hydrogen atom, an alkyl group, a cycloalkyl group, an alkoxy group, an aryl group, an aralkyl group, a hydroxyl group, an amino group, a dialkylamino group, a diarylamino group, a diaralkylamino group, a halogen atom, a halogen-substituted alkyl group, a halogen-substituted aryl group, a cyano group, a formyl group, a carboxyl group, a carbamoyl group, an N-substituted carbamoyl group, an alkoxycarbonyl group, an acyloxy group, an acyl group, an arylcarbonyl group, a nitro group, a sulfonic acid group, an alkylsulfonyl group, a substituted sulfonyl group, a sulfamoyl group, an N-substituted sulfamoyl group or a substituted sulfinyl group, provided that when D is a hydrogen atom, $R_1$ and $R_2$ are not simultaneously hydrogen atoms and at least one substituent other than a hydrogen atom is substituted at the 2-position, or $R_1$ and $R_2$ together form a ring),

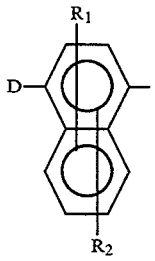

(wherein D, $R_1$ and $R_2$ are as defined above, provided that when D is a hydrogen atom, $R_1$ and $R_2$ are not simultaneously hydrogen atoms and at least one substituent other than a hydrogen atom is substituted at the 2-position, and $R_1$ and $R_2$ do not form a ring), or

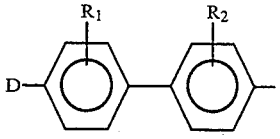

(wherein D, $R_1$ and $R_2$ are as defined above, provided that when D is a hydrogen atom, $R_1$ and $R_2$ are not simultaneously hydrogen atoms and at least one substituent other than a hydrogen atom is substituted at the 3-position, and $R_1$ and $R_2$ do not form a ring), and Y is a hydrogen atom, an alkyl group or an aryl group.

2. The electrostatic image developing toner according to claim 1, which comprises 100 parts by weight of a binder resin, from 1 to 15 parts by weight of a coloring agent and from 0.1 to 10 parts by weight of the compound of the formula (1).

3. The electrostatic image developing toner according to claim 1, wherein the electron donating group for D is an alkyl group, a cycloalkyl group, an alkoxy group, an aryl group, an aralkyl group, a hydroxyl group, an amino group, a dialkylamino group, a diarylamino group or a diaralkylamino group.

4. The electrostatic image developing toner according to claim 1, wherein the compound of the formula (1) is one of the following compounds:

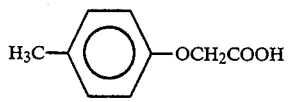

Compound No. 1

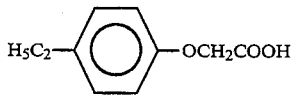

Compound No. 2

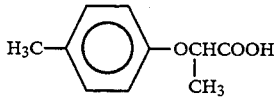

Compound No. 3

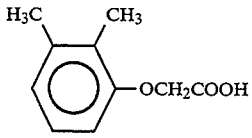

Compound No. 4

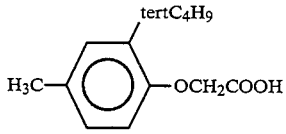

Compound No. 5

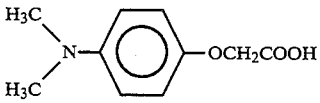

Compound No. 6

-continued
Compound No. 7
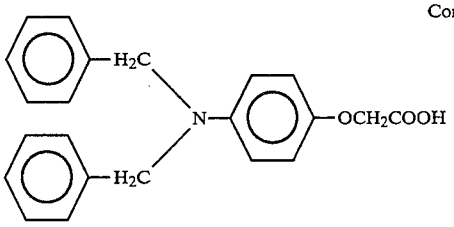
Compound No. 8
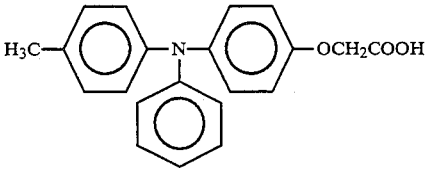
Compound No. 9
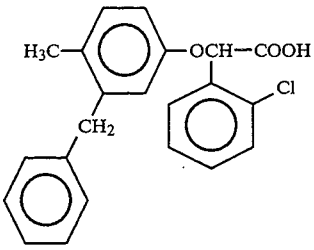
Compound No. 10
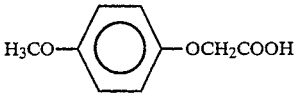
Compound No. 11
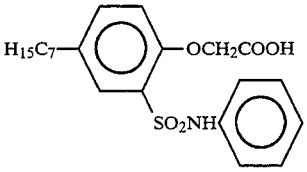
Compound No. 12
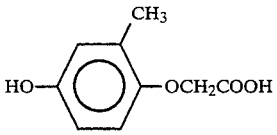
Compound No. 13
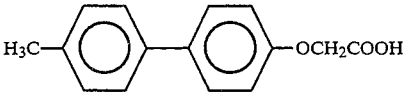
Compound No. 14
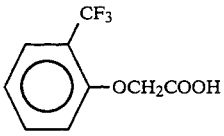
Compound No. 15
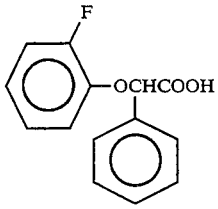
-continued
Compound No. 16
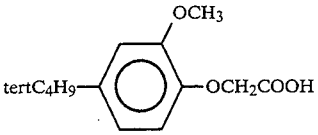
Compound No. 17
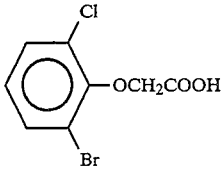
Compound No. 18
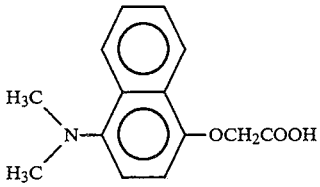
Compound No. 19
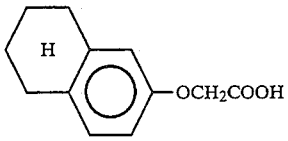
Compound No. 20
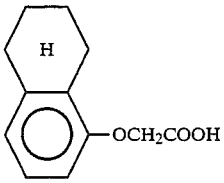
Compound No. 21
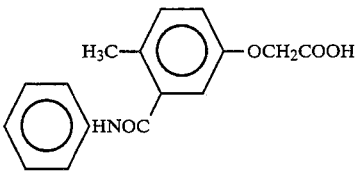
Compound No. 22
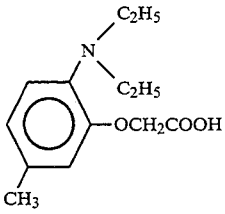
Compound No. 23
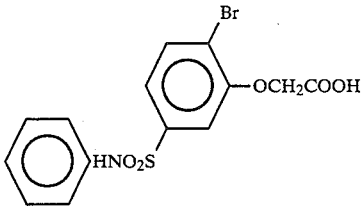

-continued
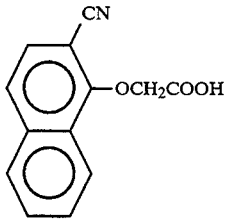
Compound No. 24
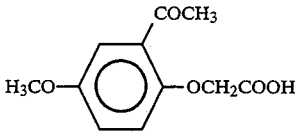
Compound No. 25
-continued
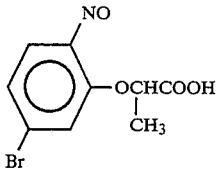
Compound No. 26
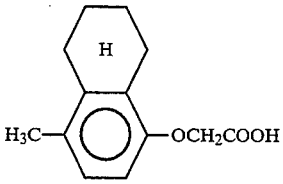
Compound No. 27
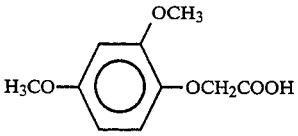
Compound No. 28
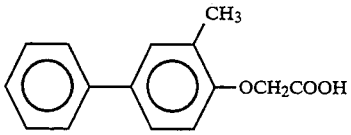
Compound No. 29
* * * * *